United States Patent [19]

Staples

[11] 4,022,407

[45] May 10, 1977

[54] RAILROAD TRAFFIC CONTROL SIGNALING SYSTEM

[75] Inventor: Crawford E. Staples, Edgewood, Pa.

[73] Assignee: Westinghouse Air Brake Company, Swissvale, Pa.

[22] Filed: Jan. 16, 1976

[21] Appl. No.: 649,910

[52] U.S. Cl. ..... 246/34 R; 246/134

[51] Int. Cl.[2] ..... B61L 19/16

[58] Field of Search ..... 235/150.24; 246/34 R, 246/34 B, 34 CT, 63 R, 63 A, 122 R, 134, 167 R; 340/38 R, 38 L

[56] References Cited

UNITED STATES PATENTS

| | | | |
|---|---|---|---|
| 2,954,463 | 9/1960 | Ihrie | 246/34 R X |
| 3,260,842 | 7/1966 | Davison et al. | 246/34 R X |
| 3,286,091 | 11/1966 | Ferm et al. | 246/34 R X |
| 3,907,237 | 9/1975 | Staples | 246/34 CT X |
| 3,937,427 | 2/1976 | Buzzard | 246/34 CT |
| 3,937,428 | 2/1976 | Elder | 246/34 R |

*Primary Examiner*—Stephen G. Kunin
*Attorney, Agent, or Firm*—A. G. Williamson, Jr.; R. W. McIntire, Jr.

[57] ABSTRACT

Separate traffic and block clear indication line circuits control either direction train movements through a stretch of track under cab signal indications without intermediate wayside signals. Reversible phase sensitive track circuits provide train detection and cab signal energy. A block clear, opposing locking repeater relay and a traffic route request relay at the selected entrance end of the stretch control the traffic line circuit to initiate traffic reversal operations. The magnetic stick traffic relays are shunted by a back contact of a neutral line relay to protect against lock out of the traffic line circuit by external voltage surges. The direction of the block clear line circuit is established by the traffic relay position. This second line circuit also checks the track sections unoccupied, the opposing signal, and traffic locking conditions before energizing a block or super-clear relay at the entrance end of the traffic stretch. The super-clear relay provides a special proceed signal indication, when the regular entry signal is cleared, to authorize movement by a train with inoperative cab signals. Time delays are incorporated into the relay operations as required to assure the reversal of all traffic relays during a traffic reversal procedure in order to avoid lock out of the traffic line circuit.

19 Claims, 2 Drawing Figures

RAILROAD TRAFFIC CONTROL SIGNALING SYSTEM

BACKGROUND OF THE INVENTION

My invention pertains to a railroad traffic control signaling system. More specifically, this invention relates to a railroad signaling system for a stretch of track without wayside signals which provides a special proceed signal indication for trains having inoperative cab signal apparatus and a coordinated traffic direction control circuit to eliminate traffic reversal timing problems.

One simple method of controlling either direction operation over a stretch of track having no wayside intermediate signals, and traversed by trains equipped with cab signal apparatus, is to control the reversible coded track circuits within the stretch by a polarized traffic line circuit. A single track circuit energy source and train detector/track relay set is switched between adjoining track sections at intermediate locations with changes in the traffic direction, thus saving on the total amount of apparatus required. Since traffic relays normally used vary in operating time, one problem encountered with this signaling arrangement is to ensure that all traffic relays reverse during the establishing of a new traffic direction since a release of the decoding relays during track circuit reversal may otherwise lock out the traffic line circuit operation. In other words, some means must be supplied to provide a delay time before the traffic line circuit is deenergized. The use of slow release traffic reversal control relays and control of the traffic relay from the ends of the line circuit provides the necessary time delay. Another problem encountered is the delay which trains having nonoperative cab signal apparatus incur. Without wayside signals, these trains must move at a restricted speed which results in further delays to following or opposing trains and thus a serious interruption of the entire schedule of operation. A solution to this problem is to provide a special signal indication at the last wayside signal control point or interlocking where trains enter the single track stretch. This additional signal, if displayed, designates that a clear block exist to the next control location where a wayside signal is positioned, that the traffic direction is in the proper condition, and that there are no opposing movements authorized or occurring. The train with the inoperative cab signals is then authorized to proceed through the stretch of track without cab signal indications at a predetermined maximum speed limit. Such a block clear or super-clear indication may be provided by an additional line circuit which will simplify the traffic line circuit and thus reduce the total relay requirement for the overall system and at the same time improve its operation.

Accordingly, an object of my invention is a railroad traffic control and signaling system providing an improved operation in reversing the traffic direction.

Another object of the invention is a railroad traffic control and signaling system which provides a special block clear indication to authorize movement of a train with inoperative cab signal apparatus through the controlled stretch of track.

A further object of my invention is a traffic control line circuit, for use in a railroad signaling system, which uses slow release control relays to assure the completion of the traffic reversal procedures without requiring extra timing relays.

Yet another object of the invention is a railroad signaling system with traffic control line circuits which provide an independent clear block indication while yet assuring the completion of the traffic reversal procedures.

A still further object of the invention is a traffic direction control arrangement for a railroad signaling system in which the traffic reversal timing is correlated and controlled external to the actual traffic line circuit arrangement.

It is also an object of my invention to provide an improved traffic direction control arrangement for a railroad signaling system without wayside signals which overcomes traffic reversal timing problems and also provides a clear block indication to authorize train movements through the stretch or signal block when cab signal apparatus is inoperative.

Other objects, features, and advantages of my invention will become apparent from the following specification when taken in connection with the accompanying drawings and the appended claims.

SUMMARY OF THE INVENTION

In practicing my invention, a stretch of railroad track between stations, that is, a station-to-station block, is divided into several track sections. Each of these sections is provided with a phase sensitive, coded track circuit. Although the specific showing is of a single code rate and decoding unit, more than one code rate may be used if desired to control different signal indications for different train speeds. No wayside signals are used in the station-to-station block except at the entry point. Trains traversing the block are provided with cab signal apparatus and train speeds are then controlled in accordance with the cab signal indication. The track circuit network, which provides train detection and cab signal energy, is reversible in order to establish either direction of traffic through the station-to-station block. The direction of the track circuits is controlled by traffic relays at each end location and at each intermediate junction location between track sections. These polarized traffic relays are included in a line circuit network controlled by remotely controlled route request relays at each station location to shift the direction of the traffic. The traffic direction is shifted, however, only if a traffic reversal control relay at the selected exit end is picked up to indicate a clear block and no opposing train authorized entry. If these conditions exist, polarized energy is supplied at the selected exit end to the traffic line circuit. The operation of the traffic relays is delayed until neutral repeater relays are picked up to interrupt the shunt associated with the traffic relay winding. This protects against surges of energy, occurring in the traffic line circuit from external causes, from causing some traffic relays to improperly operate to the wrong position during an established traffic condition. In an emergency, if lockout occurs from any cause, a maintainer can reposition all traffic relays to the same position by applying energy of preselected polarity at one end of the traffic circuit.

At each entrance location, the arrangement also supplies a block clear indication relay, also known as a super-clear relay, wich is controlled by a second line circuit reversible in accordance with the position of the traffic relay contacts. In other words, the active block indication relay is that one at the established entrance end to the stretch of railroad track. This second line circuit checks selected ones of the track circuit decoding relays to determine block occupancy conditions and also checks, through entry locking relay contacts, the condition of the entry signal at the opposite end and the occupancy condition of the opposing entry detection section. Each traffic control relay repeats this super-clear relay and the entry locking relay at the same end. Since the various traffic relays inherently have different operating times, the traffic reversal control relay at each end is provided with slow release characteristics to maintain the traffic line circuit energized during traffic reversals for a sufficient period to assure that all traffic relays operate to the new position. This energy for the traffic reversal is of course supplied to the traffic line circuit from the newly selected exit end of the stretch for the desired traffic direction. At the new entrance end to the stretch, once traffic is established, the reversed condition of the track circuits then makes it possible to clear the entrance signal and to provide cab signal indications as the train moves through the stretch of track. However, the super-clear relay at the established entrance end is used to provide a special signal indication, when the entire block is checked clear, the traffic direction is established, and no opposing move is set up, which authorizes a train with inoperative cab signal apparatus to proceed through the block on the authority of the stretch entering signal and the super-clear signal.

BRIEF DESCRIPTION OF THE DRAWINGS

I shall now describe in greater detail a specific signaling system embodying my invention, referring from time to time to the accompanying drawings in which.

Figure 1:
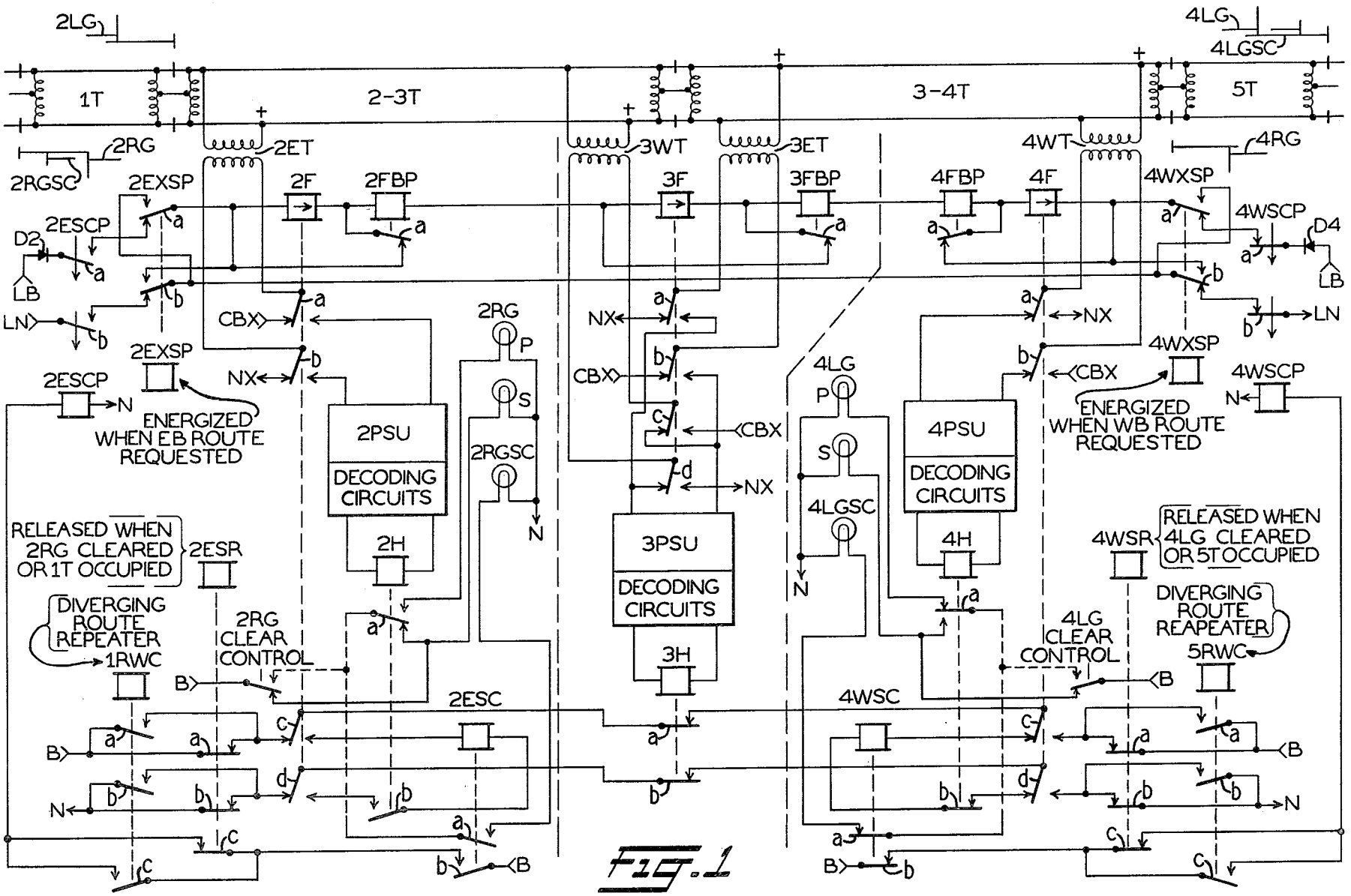
FIG. 1 is a partly schematic circuit diagram illustrating a railway signaling and traffic control system embodying the invention.

In each of the drawing figures, similar reference characters designate the same or similar parts of the apparatus. At each location along the stretch of track, a low voltage source of direct current energy is supplied to furnish operating energy for the various relays and other apparatus. The specific energy source is not shown at any location since any one of several different types conventionally used in signaling systems may be used. Rather, the positive and negative teminals of this source of energy at each location are designated by the reference characters B and N, respectively, and each appearance of these references designates a connection to the corresponding terminal of the direct current energy source. A source of higher voltage direct current energy is necessary for the traffic line circuit and again the actual source is not shown but its positive and negative terminals are designated by the reference LB and LN, respectively. For supplying energy to the phase selective track circuits, an alternating current source is required and for convenience its terminals are shown by the references CBX and NX, the CBX terminal indicating the supply of such energy pulsed at a preselected code rate. This coded energy may be provided or developed in any conventional manner well known in the railroad signaling art and, if desired, may provide more than one code rate or frequency although but a single frequency is here assumed. The various relays are shown by conventional symbols and their contacts may be shown above or below the operating winding. Such contacts are designated by lower case letters unique for each relay. The traffic relays F are of the magnetic stick type as designate by the arrow shown within the relay winding symbol and the movable portion of the contact armature being positioned in a vertical alignment. When energized by current flowing in the direction of the arrow, such relays operate their contacts to close in the left or normal position. They respond to energizing current of the opposite direction to close right or reverse contacts. When the winding of these relays is deenergized, the contacts remain closed in the position to which last operated.

DESCRIPTION OF THE ILLUSTRATED EMBODIMENTS

I shall now refer to FIG. 1 to describe a specific arrangement of a railroad traffic control signaling system embodying my invention. Across the top of the drawing, illustrated by a conventional two-line symbol, is a stretch of railroad track which represents a station-to-station block through which trains move in either direction. The stretch is divided into insulated track sections designated, from the left, 1T, 2-3T, 3-4T, and 5T. Track sections 1T and 5T represent block entry detector sections in which switches may be located by which trains may be diverted to a branch line or to a parallel track. Wayside signal governing train movements in each direction are located at opposite ends of each of these detector track sections. For example, at section 1T, a signal 2LG governs trains moving in the westbound (left) direction as they leave the stretch of track illustrated. Conversely, the signal 2RG governs trains entering the stretch of track moving in the eastbound direction. A second arm on this eastbound signal designated 2RGSC provides at times a special or super-clear indication for trains to authorize further movement when cab signals are inoperative. Corresponding signals 4RG, 4LG, and 4LGSC are located at section 5T to govern east and west train movements, respectively, at that end of the stretch of track. No other wayside signals are located within the stretch of track, the trains operating normally by cab signal indication. It is to be understood, of course, that in most such station-to-station blocks there will be more than two track sections such as 2-3T and 3-4T. However, for simplicity, only two are shown here, this being sufficient for an understanding of the invention. The apparatus located at each end of the stretch and at the center location where the track sections adjoin are separated by the vertical dash lines in this drawing.

Each of the illustrated track sections is provided with a track circuit. Although the system of my invention is not limited to use on electrified railroads, it is to be noted that, for illustration purposes, the sections are here coupled by conventional impedance bonds to establish a return circuit for the alternating current which is used as propulsion energy for the trains. For example, the propulsion energy may have a frequency of 60 Hz while the track circuit energy is supplied at a frequency of 100 Hz. The track circuits for detector sections 1T and 5T are not specifically shown since they may be any known type, e.g., coded or noncoded circuits energized with alternating current of 100 Hz frequency or direct current circuits with superposed coded 100 Hz cab signal energy. The occupancy condition of these detector sections enters into the control arrangement through the response of other relays which will be discussed later and therefore the detector track relays need not be specifically shown.

For the intermediate sections within the stretch, it is assumed that coded phase sensitive or phase selective track circuits using an alternating current, e.g., at 100 Hz, are provided, although other types of coded track circuits may also be used. The source and the receiver apparatus at each end are coupled to the rails through track transformers such as transformers 2ET and 3WT at the west and east ends of section 2-3T, respectively. The phase sensitive track circuit for each intermediate section is, of course, reversible in accordance with the traffic direction, that is, coded energy is supplied at the west or the east end in accordance with the establishment of westbound or eastbound traffic, respectively. The shift between the source and receivers at each location is made by the contacts of the associated traffic relay F. It is to be noted that the apparatus as specifically shown is in the condition existing when westbound traffic is established, there is no train within the station-to-station block, and no entry signal has been cleared. Under these conditions, energy for the track circuit for section 2-3T is supplied from terminals CBX and NX over normal contacts *a* and *b*, respectively, of traffic relay 2F to the primary of transformer 2ET and thence from the secondary to the rails. Although, as previously mentioned, if desirable, various code rates may be selectively applied to control various indications in the cab signals, it is only necessary here to understand that the energy supplied from terminal CBX is coded. At the center location, the received track circuit energy is coupled from the rails through track transformer 3WT and over normal contacts *c* and *d* of traffic relay 3F to phase sensitive unit 3PSU and then through decoding circuits to the signal relay 3H. When no train occupies section 2-3T, relay 3H will be energized and thus in its picked up condition, closing front contacts.

The phase sensitive unit and decoding circuits are shown by conventional blocks since such apparatus and circuitry are well known in the railway signaling art. For example, these units may be as shown in my prior U.S. Pat. No. 3,046,454, issued July 24, 1962, for "Code Detecting Apparatus." Correlating to may prior patent, within the block 3PSU will be such elements as those designated by the references 10, 11, K1, K2, and relay ATR. The decoding circuits includes the elements of transformer DT and the H relay corresponds to relay RNR in the prior patent. For simplicity, the supplemental arrangement shown in FIG. 2 of the prior patent may be substituted into the arrangement to eliminate the additional relay ATR.

A similar track circuit exists for section 3-4T. With westbound traffic, energy is supplied from the center location and received at the east end of the block. It is to be noted that the instantaneous polarity of the track circuit energy in the rails is reversed from section to section for the detection of defective insulated joints. If the direction of the track circuits is reversed for eastbound traffic, the rails of section 2-3T are supplied with energy from terminals CBX and NX at the center location over reverse contacts *c* and *d* of relay 3F and coupled to the rails through transformer 3WT. Correspondingly, at the west end the energy from the rails is coupled through transformer 2ET and over reverse contacts *a* and *b* of relay 2F to phase sensitive unit 2PSU and thence to the decoding circuits to energize relay 2H. It may be noted that, if the position of the traffic relays throughout the block are not in agreement, one or more of the H relays will be released to detect this fault condition. At each intermediate location, i.e., junction or insulated joints between adjoining sections, only one set of track circuit apparatus is needed since the single PSU, decoding circuits, and H relay set is connected to the rails of the section which a train will enter in accordance with the established traffic direction. Similarly, if any special apparatus is used for the track circuit energy source, only a single set is required. This reduces the quantity of apparatus needed for a complete system.

The signal or decoding relay H at each end location makes the final selection, after a train movement is authorized, of the indication displayed by the wayside signal which controls the entry of trains into the stretch of track shown. For example, at the west end, signal 2RG governing eastbound train moves is controlled by the 2RG clear control contact, conventionally shown in the lower left, over a circuit including various track occupancy and traffic condition checks, conventionally shown by the dotted line, with the final selection between the proceed and stop signal indications made by contact *a* of relay 2H. In other words, when back contact *a* of relay 2H is closed, as illustrated, only the stop signal indication can be displayed by signal 2RG as designated by the conventionally shown signal lamp S. If relay 2H is energized, the closing of its front contacts selects a proceed indication on signal 2RG by energizing the signal lamp P. Under at-rest conditions, with no movement cleared, the S lamp of signal 2RG is energized over contact 2RG closed in its back position. The lower arm of this wayside signal, illustrated by the lamp 2RGSC, provides a block clear or super-clear indication when the corresponding block indication or super-clear relay 2ESC is energized to close its front contact *a*. As shown by the illustrated circuit, a proceed signal control must have been authorized by the system operator so that the 2RG clear control front contact is closed and the various circuit checks made to complete the signal circuit. As previously mentioned, the display of signal 2RGSC authorizes a train with an inoperative cab signal apparatus to proceed through the station-to-station block to signal 4RG at the next station location. Similar circuits are provided to control signal 4LG and its corresponding to associated lower arm at the east end of the block. The selection of the indication displayed is made by relay 4H with relay 4WSC controlling the display of the super-clear indication. Control circuits for the other illustrated wayside signals 2LG and 4RG do not enter into the arrangement of the invention and are not shown.

The block indication or super-clear relays are controlled by a reversible line circuit which is shown across the bottom of the circuit diagram in FIG. 1. Entering into the control of this line circuit at each end location are an entry locking relay and a diverging route repeater relay. For example, at the west end (left side of the drawing), an entry locking relay 2ESR, as designated by the associated legend, is released when signal 2RG is cleared to authorize an entering train movement or when a train occupies section 1T. However, if a diverging movement has been established from section 1T into a branch or parallel track, a diverging route repeater relay 1RWC is energized and picked up for purposes which will be shortly described. With westbound traffic established in the condition shown, the block indication or super-clear relay 4WSC at the east end is energized. The circuit may be traced from terminal B at the left over front contact *a* of relay 2ESR, normal contact *c* of relay 2F, front contact *a* of relay 3H at the center location, normal contact c of relay 4F, the winding of relay 4WSC, front contact *b* of relay 4H, normal contact *d* of relay 4F, front contact *b* of relay 3H, normal contact *d* of relay 2F, and front contact *b* of relay 2ESR to terminal N. If a diverging route has been established at the west end, front contacts *a* and *b* of relay 1RWC bypass front contacts *a* and *b* of relay 2ESR since a diverging route will allow signal 2RG to be cleared and the train will still not enter the block. It is not necessary to check the traffic relay positions at the intermediate locations, such as the center location in the illustration, since any disagreement between traffic relay positions will cause at least one of the decoding relays H to be deenergized and thus interrupt the block indication circuit. The front contacts of relay 2ESR protect against the clearing of the opposing signal or the overrun of that signal and occupancy of section 1T. Under eastbound traffic conditions, relay 2ESC is energized by a similar circuit which includes, of course, the reverse contacts of relays 2F and 4F and under normal conditions front contacts *a* and *b* of relay 4WSR at the east end location. The latter contacts are bypassed, if a diverging route has been established in section 5T, by front contacts *a* and *b* of relay 5RWC. In addition to controlling the superclear indication on the stretch entering signals, the SC relays can also provide a clear block indication to the remote control location.

At each end location is a traffic reversal control relay SCP which must be energized in order that the traffic direction route for which that end is the exit may be established. Each of these relays repeats the joint energized conditions of the associated SC and SR relays. For example, traffic reversal control relay 4WSP at the east end, with west bound traffic established, is energized by the circuit including front contact *b* of relay 4WSC and front contact *c* of relay 4WSR. If a diverging route is set up through section 5T, front contact *c* of relay 5RWC bypasses front contact *c* of relay 4WSR to maintain relay 4WSCP energized when signal 4LG is cleared for, and/or the train occupies section 5T along, the diverging route. At the west end, the circuit for traffic reversal control relay 2ESCP includes front contact *b* of relay 2ESC and, in multiple, front contact *c* of relay 2ESR and front contact *c* of relay 1RWC. Relay 2ESCP is energized only when the eastbound traffic route is established. Both relays 2ESCP and 4WSCP are provided with slow release characteristics, as designated by the downward pointing arrow drawn through the movable portion of each contact.

The traffic relays are controlled by a second reversible line circuit, the traffic control circuit network shown across the top of the drawing. Further, each traffic relay F has an associated auxiliary relay, the traffic relay shunting relay FBP whose back contact *a* shunts the winding of the associated traffic relay to protect against inadvertent operation of a traffic relay due to induced line circuit voltage surges. As a specific example, back contact *a* of relay 2FBP shunts the winding of traffic relay 2F and thus prevents the operation of relay 2F by any externally induced line surges. The traffic line circuit is normally deenergized but since the traffic relays are of the magnetic stick type, contacts hold in the position to which last operated. Thus, since westbound traffic direction is established in the conditions shown, the contacts of all the traffic relays are closed in their normal or left-hand position. It will now be assumed that eastbound traffic is to be established, that is, a traffic reversal operation is to be undertaken. Routing relay 2EXSP, as a result of a received control function requesting an eastbound route, is energized and picks up to close its front contacts *a* and *b*. This places a shunt on the west end of the traffic line circuit, completing a loop arrangement which excludes the energy source at this west end from the circuit. Assuming that relay 4WSCP is picked up as shown, the line circuit is then complete for reversing the traffic direction. This may be traced from terminal LB of the line circuit source at the east end through blocking diode D4 over front contact *a* of relay 4WSCP, back contact *a* of 4WXSP, back contact *a* and the winding of relay 4FBP, the winding and back contact *a* of relay 3FBP, the winding and back contact *a* of relay 2FBP, front contacts *a* and *b* of relay 2EXSP in multiple, back contact *b* of relay 4WXSP, and front contact *b* of relay 4WSCP to terminal LN. As each relay FBP picks up to open its back contact *a*, the shunt is removed from the winding of the associated traffic relay which is then reenergized by current in reverse direction so that it operates its contacts to the reverse position. For example, when relay 4FBP picks up, the opening of its back contact *a* removes the shunt from the winding of traffic relay 4F which is then reverse energized and operates its contacts to close in the reverse position. This operation, that is, the line circuit reversal, is completed provided, of course, that the block is clear, that no entering signal is cleared at the east end, that no westbound train has passed signal 4LG, and that no request for a westbound route has been registered. However, if relay 5RWC is energized, its front contact *c* holds relay 4WSCP energized so that the condition of signal 4LG and the occupancy of section 5T are immaterial.

When relay 2F or 4F reverses, whichever is first, relay 4WSC is deenergized and releases since the block indication line circuit is interrupted at that time. Opening of front contact *b* of relay 4WSC deenergizes relay 4WSCP but this relay, being provided with slow release characteristics, holds its front contacts closed for the slow release period. This assures that sufficient time elapses so that all traffic relays are reversed by the energy supplied over the front contacts of this 4WSCP relay. When the contacts of relay 4WSCP finally release, the traffic line circuit is deenergized and the traffic relays then hold in their reverse position.

With relays 2F and 3F reversed, the track circuit for section 2-3T is reversed, now being supplied with energy from the intermediate location which is received by unit 2PSU and the decoding circuits at the west end so that relay 2H becomes energized. The track circuit for section 2-4T is likewise reversed so that energy is supplied over reverse contacts *a* and *b* of relay 4F and applied over reverse contacts *a* and *b* of relay 3F to unit 3PSU and thence through the decoding circuits to energize relay 3H. The phase sensitive unit 4PSU and the associated decoding circuits at the east end are disconnected from the track coupling and relay 4H releases and remains in that condition. It is then to be noted that, at this time, with relays 4H and 4WSC released, signals 4LG and 4LGSC cannot display any proceed indication regardless of what signal control might be inadvertently registered by the 4LG clear control contact.

The second or block clear line circuit is now reversed and completed in a fashion to energize relay 2ESC. This assumes that relay 4WSR is picked up so that the circuit includes front contacts *a* and *b* of this relay, reverse contacts *c* and *d* of relay 4F, front contacts *a* and *b* of relay 3H, reverse contacts *c* and *d* of relay 2F, front contact *b* of relay 2H, and the winding of relay 2ESC. Energy is thus supplied from terminals B and N at the east end to energize this last relay which picks up. If a diverging route has been established in section 5T so that front contacts *a* and *b* of relay 5RWC are closed, the position of relay 4WSR is immaterial and relay 2ESC will be energized even though the signal for the diverging route has been cleared.

With relay 2H picked up, signal 2RG may now be cleared by the registry of a clear control function received from the remote location. This established a circuit through the various check arrangements, as previously described, for energizing the signal lamp P of signal 2RG. Once this clear signal is registered and with relay 2ESC picked up, the circuit is also complete for displaying the super-clear signal indication on lamp 2RGSC over front contact *a* of relay 2ESC. With signal 2RG clear, it may be noted that relay 2ESR is released so that the circuit for relay 2ESCP is interrupted at front contact *c* of relay 2ESR even though front contact *b* of relay 2ESC is closed. Thus, there can be no further reversal of the traffic circuit since front contacts *a* and *b* of relay 2ESCP remain open.

When the train for which signal 2RG was cleared moves through the stretch and clears section 5T moving in an eastbound direction, the circuit is completed for relay 2ESCP. In other words, signal 2RG is restored to its stop condition when the train passes that signal and relay 2ESR can then pick up when section 1T is cleared by the train. Thus, when the stretch including section 5T is clear and relay 2ESC again picks up, the circuit including front contact *b* of relay 2ESC and either front contact *c* of relay 2ESR or front contact c of relay 1RWC is complete for energizing relay 2ESCP. Relay 2EXSP is also restored to its normal released condition by or after the passage of the train. Conditions are now prepared for reversing the traffic circuit, if desired, to establish the westbound traffic direction. This would be accomplished by registering a route request at the east end so that relay 4WXSP picks up to provide a shunt on the traffic circuit. Energy is then supplied through blocking diode D2 and over front contacts *a* and *b* of relay 2ESCP and back contacts *a* and *b* of relay 2EXSP to the traffic line circuit. Thus when the shunting relays pick up, the traffic relays are energized by current flowing in the normal direction so that they operate their contacts to close in the normal position.

In the traffic reversal operation, the energization and deenergization of relays 2EXSP and 4WSCP, or relays 4WXSP and 2ESCP, are not specifically coordinate. Since the required time to reverse individual traffic relays differs, it is possible, even though unlikely, to energize the traffic line circuit long enough to reverse some traffic relays but not others. This would cause the block to indicate occupied and disrupt traffic. This could especially occur if attempts were inadvertently made simultaneously to clear movements into the block from both ends, releasing relay 4WSR and consequently relay 4WSCP immediately after relay 2EXSP picks up, or by deenerizing relay 2EXSP immediately after relay 4WSCP picks up. This critical time period is short, representing only a fraction of a second, and ordinarily such lock-up will not happen. If operators control the two interlockings at each end of the signal block, they will be in communication and coordinate their lever operation. When centralized remote control is used, the time between control function transmissions to different locations normally prevents the occurrence of simultaneously registering requests and control machine circuitry can be used also to prevent such occurrence. However, conditions may occur inadvertently in some installations which would lock up the line circuit and thus interrupt traffic flow. The separate traffic circuit network of this arrangement, i.e., without integral track occupancy and approach locking checks, has a distinct advantage if lock out inadvertently occurs. Energy of the proper polarity applied across the line wires at one end, e.g., at heels of contacts *a* and *b* of relay 4WXSP, will reposition all traffic relays to the same position to establish a predetermined traffic direction and restore the system to normal operation. Also, if a track circuit failure in any one track section inhibits traffic reversal, thus threatening train delays of a serious nature, maintainers at each end of the stretch, directed by interlocking operators at the same locations or by a single remote controller as to safety conditions, can apply line energy of selected polarity to reverse traffic direction as desired. This will permit train operation through stretch in each direction, with severely restricted speed only in the faulty section, until track circuit fault is corrected.

Figure 2:
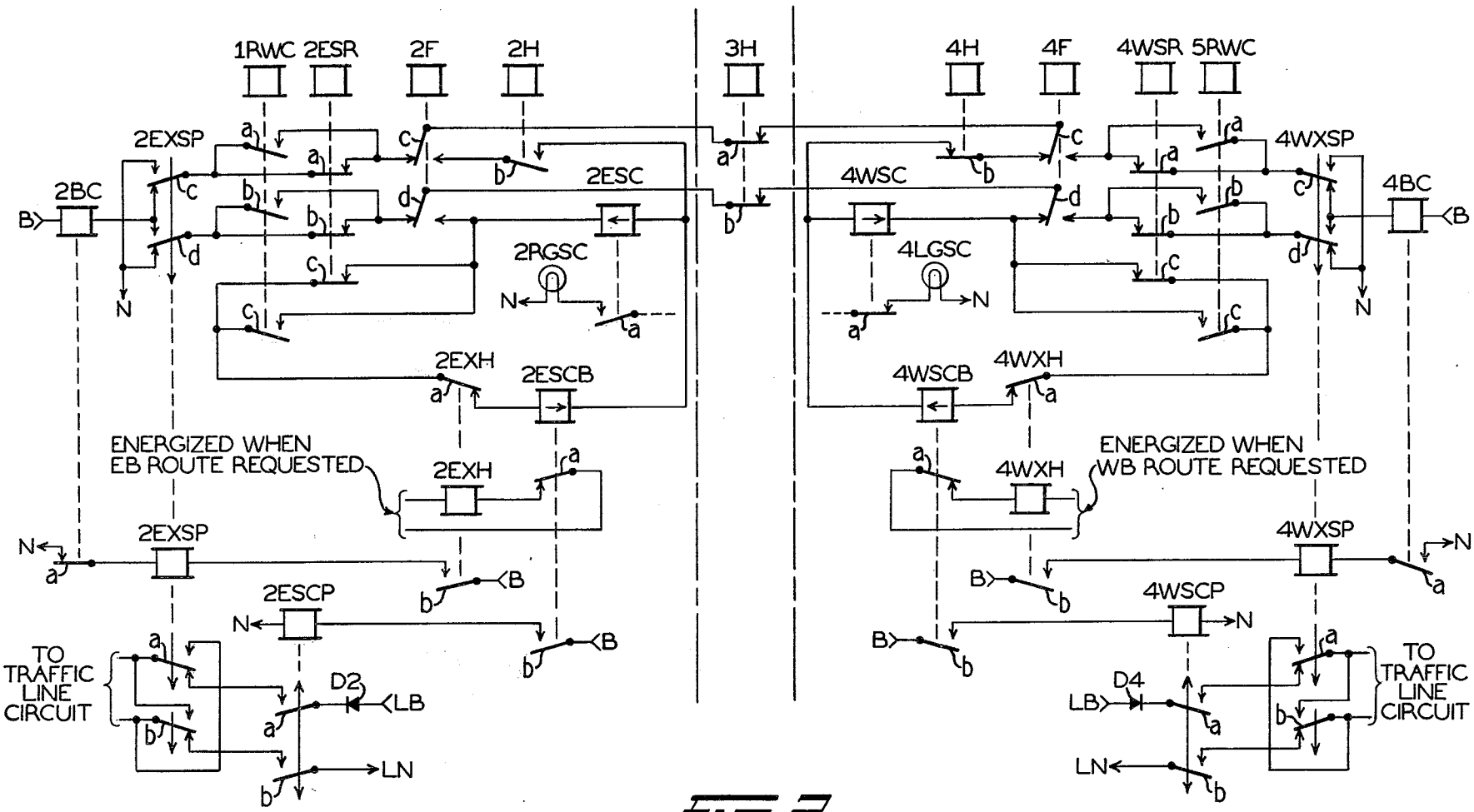
FIG. 2 is a circuit diagram showing a modified form of a block occupancy indication line circuit which may be substituted into the system of FIG. 1.

The alternate or modified arrangement of FIG. 2 provides a means for absolutely preventing an occurrence and may be substituted for the block indication line circuit network at the bottom of FIG. 1. Referring now to FIG. 2, across the top is a row of symbols representing relays already shown in FIG. 1. The control and operation of each of these relays is the same as previously described and the control circuits are not again shown. Further, since these relay symbols include the traffic relays, there is no basic change in the traffic line circuit and therefore only two small portions at the west and east end are shown at the lower left and right, respectively. The only change is in the characteristics of the relays which control the contacts shown in these portions. The XSP relays are now provided with slow release characteristics while the SCP relays, in addition to the prior slow release characteristics, are also provided with a slow pick up characteristic, as designated by the upward pointng arrow added to the line drawn through the relay contacts. In other words, when either of the SCP relays is energized, there is a time delay before the relay response to pick up its contacts and close them in the front position. The control circuits for the XSP and SCP relays in this modified arrangement are different and will be discussed shortly.

The principal modifications are in the block clear or super-clear line circuit. The first change is to add a block clear relay BC in series with the supply from the positive battery terminal at each end of the line circuit. These are the relays 2BC and 4BC connected in series between terminal B at the corresponding end and the first set of relay contacts. A second change is the insertion of a pair of polarity reversing contacts of the corresponding XSP relay at each end of this block clear line circuit. These contacts are inserted between the winding of the BC relay and the multiple path through the SR and RWC relay contacts at the corresponding end. In the other portion of the line circuit at each end, that is, the portion connected when the associated traffic relay is in the entrance end position or opposite from that in which energy is supplied, a second or supplementary super-clear relay SCB is connected in multiple with the original SC relay. Each super-clear relay at each end is now a biased relay as indicated by the arrow shown within the relay winding symbol. In operation, biased relays will only respond to energy when the current flows in the direction of the arrow symbol. That is, these relays respond to pick up and close front contacts only when the energizing current flows through the relay winding in the direction of the arrow. When deenergized or when current flows in the direction opposite to the arrow, the relays release or remain released with back contacts closed. At each end, the associated SC and SCB relays are connected in the multiple circuit arrangement with opposite polarity. Also, each SCB relay winding has a lower resistance than the associated SC relay in order to provide a larger change (reduction) in current through the BC relay at the opposite end of the line circuit when the circuit through the SCB relay is interrupted. Each BC relay is so adjusted that it picks up only when both multiple paths through relays SC and SCB at the opposite end are complete. If only relay SC is energized, insufficient current flows to retain relay BC picked up. Still another change in the overall arrangement adds a relay XH to repeat the route request. For example, at the west end, relay 2EXH repeats a request for an eastbound route while at the east end, relay 4WXH repeats the request for a westbound route, as indicated by the explanatory notes. The control circuit for each XH relay includes a back contact *a* of the associated SCB relay so that the registry of a control function from the remote control location is ineffective if the relay SCB has already picked up to open its back contact *a* in response to a route request registry at the other end.

I shall now describe the operation of the alternate arrangement of FIG. 2, assuming that, as shown in FIG. 1, the traffic is established in a westbound direction, the block is unoccupied, but signal 4LG has not been cleared for a train movement. Under these conditions, relays 2BC and 4WSC are energized through the block clear line circuit. The actual circuit path may be traced from terminal B through the winding of relay 2BC, back contact *c* of relay 2EXSP, front contact *a* of relay 2ESR, noramal contact *c* of relay 2F, front contact *a* of relay 3H at the central location, normal contact *c* of relay 4F at the east end, front contact *b* of relay 4H, the winding of relay 4WSC, normal contact *d* of relay 4F, front contact *b* of relay 3H, normal contact *d* of relay 2F, front contact *b* of relay 2ESR, and back contact *d* of relay 2EXSP to terminal N at the west end. A parallel path branches at the left terminal of the winding of relay 4WSC and extends through the winding of relay 4WSCB, back contact *a* of relay 4WXH, and front contact *c* of relay 4WSR to normal contact *d* of relay 4F where it rejoins the main circuit. In this multiple circuit arrangement at the east end, the flow of current through the winding of relay 4WSC is in the direction of the arrow so that this biased relay is properly energized to pick up but the flow of current in the winding of relay 4WSCB is opposite the arrow so that this biased relay remains releases. It may be noted that, although back contact *a* of 4WSCB thus remains closed, relay 4WXH is in its released condition since the westbound route direction was previously established and no request is presently registered. It may also be noted that, if a diverging route has been established in section 5T, front contact *c* of relay 5RWC will bypass the open front contact *c* of rlay 4WSR, in case signal 4LG has been cleared for the diverging route or section 5T is occupied by the train following that route.

I will now assume that an eastbound route request is registered so that relay 2EXH picks up since back contact *a* of relay 2ESCB is presently closed. The closing of front contact *b* of relay 2EXH then completes the circuit for relay 2EXSP since front contact *a* of relay 2BC is already closed. When relay 2EXSP picks up, its front contacts *a* and *b* provide a shunt on the west end of the traffic line circuit as previously discussed and as shown in the lower left of FIG. 2. However, unlike the traffic circuit in FIG. 1, relay 4WSCP is presently released due to open front contact *b* of relay 4WSCB so that front contacts *a* and *b* of relay 4WSCP interrupt the supply of energy to the traffic line circuit at this initial request for the traffic direction change. Contacts *c* and *d* of relay 2EXSP pole change the energy supply to the block indication line circuit. The slow release period of relay 2EXSP bridges any momentary interruption of its energizing circuit in the event relay 2BC briefly releases during the pole changing of the block clear line circuit.

Pole changing the energy supply to the block indication line circuit causes relay 4WSC to release and relay 4WSCB to pick up since the flow of current through these relay windings is now reversed and the biased relays respond in the prescribed manner. The pick up of relay 4WSCB opens its back contact *a* to interrupt the control circuit for relay 4WXH so that hereafter no westbound traffic request can be registered. The closing of front contact *b* of relay 4WSCB energizes relay 4WSCP. However, this latter relay has slow pick up characteristics so that it does not immediately respond to the energization of its winding to close front contacts. This pick up delay provides a time check that no pick up of relay 4WXH or release of relay 4WSR has simultaneously occurred during this registry of the request for the eastbound traffic direction. This is one of the criteria for which this modification was designed. In other words, the delay in pick up of relay 4WSCP assures that, if nearly simultaneously with the pick up of relay 2EXSP, either relay 4WXH picks up or 4WSR releases, thus again releasing relay 4WSCB, the energizing circuit for relay 4WSCP will be interrupted prior to actual pick up and the westbound traffic request relay 4WXH or the westbound locking relay 4WSR will assume control to prevent any lock out in the traffic circuit. When relay 4WSCP picks up the closing of its front contacts *a* and *b* energizes the traffic line circuit through blocking diode D4, causing the traffic relays to reverse their positions to establish eastbound traffic. Since the reversal of the traffic relays deenergizes relay 4WSCB, thus interrupting the energizing circuit for relay 4WSCP, this latter relay is provided with slow release characteristics to assure the reversal of all the traffic relays prior to the opening of its front contacts *a* an *b*. All of these timing characteristics prevent any lock up of the traffic line circuit during reversal of traffic direction due to any inadvertent external actions or circuit operations.

The remainder of the operation of the apparatus of FIG. 2 is similar to that of FIG. 1. In other words, at the end of the traffic reversal operation, traffic relays 2F and 4F as well as 3F at the central location have operated to their reverse position. Relays 2H and 3H are energized by the track circuits and decoding apparatus and have picked up. In the block indication line circuit, relays 4BC and 3ESC are energized and picked up.

Relay 2ESCB is also energized but remains in its released position since the flow of current is in the opposite direction to the arrow. It is to be noted that, if a diverging route had been established in section 5T, front contacts *a* and *b* of relay 5RWC replace front contacts *a* and *b* of relay 4WSR in the block indication of circuit to hold the circuit complete and thus the relays energized. When signal 2RG is cleared to actually authorize a train movement, the super-clear indication on lamp 2RGSC is also energized since front contact *a* of relay 2ESC is closed in the manner described previously for FIG. 1. The restoration of the westbound traffic direction, when such a request is subsequently made, occurs in a similar fashion and will be apparent from the preceding description when taken in connection with the circuits shown in FIGS. 1 and 2.

The arrangement of my invention thus provides, in an efficient and effective manner, control of traffic through a stretch of railroad track over which trains move in both directions. These trains normally operate under cab signal indications only, except for the block entry wayside signal. The arrangement also provides a block clear indication which is used to authorize trains to move through the stretch without operative cab signals. The system includes provisions to prevent lock out of the traffic control circuits due to externally induced voltage surges or inadvertent erroneous operation by the control operator or operators. This results in a signal and traffic control system which moves trains in an efficient manner to provide effective service on short headway. This operation is accomplished in an efficient, economical, and safe manner.

Although I have herein shown and described but a single arrangement, and one modification thereof, embodying my invention, it is to be understood that other changes and modifications may be made therein within the scope of the appended claims without departing from the sprirt and scope of the invention.

Having now described the invention, what I claim as new and desire to secure by Letters Patent, is:

1. A railroad traffic control system, for a stretch of track divided into a plurality of insulated track sections and through which trains move in either direction normally under the authority of train-carried cab signals, comprising in combination:

a. a reversible track circuit means for each track section for detecting the occupancy of that section by a train, b. a traffic line circuit network extending the length of said stretch and selectively reversible for requesting a traffic route direction through said stretch, c. a traffic relay at each end of said stretch controlled by said traffic line circuit network for establishing a requested direction of traffic movement through said stretch, d. a super-clear relay at each end of said stretch, e. a block indication line circuit network extending the length of said stretch, f. said block indication line circuit network coupled to each super-clear relay and jointly controlled by said traffic relays, the plurality of reversible track circuit means, and responsive to the absence of an authorization for a train to enter at an established exit end of said stretch, for energizing the super-clear relay at an established entrance end when the corresponding traffic direction is established and each track section is unoccupied, and g. a signal means at each end controlled by the corresponding super-clear relay for displaying a signal indication to authorize a train without operative cab signal apparatus to traverse said stretch when said corresponding super-clear relay is energized.

2. A railroad traffic control system as defined in claim 1 which further includes:

a. a traffic reversal control relay at each end of said stretch controlled by the associated super-clear relay to be energized when said associated super-clear relay is energized only if no train movement into said stretch at the corresponding end is authorized or initiated, and b. a traffic route request means at each end of said stretch selectively operable for requesting the establishment of a traffic route entering said stretch at the corresponding end, and in which, c. said traffic line circuit network is controlled by said traffic reversal control relays and said route request means for establishing the requested traffic route in the desired direction when the traffic route request means at the selected entrance end is operated to its request position and the traffic reversal control relay at the other end is in its energized position.

3. A railroad traffic control system as defined in claim 2 in which, a. each traffic relay is of the magnetic stick type operable to a first or a second position as the first or second direction is to be established, b. the energy supplied to said traffic line circuit network is selectively polarized by the traffic reversal control relay at the requested exit end for positioning said traffic relays in the position corresponding to the requested traffic direction.

4. A railroad traffic control system as defined in claim 3 which further includes:

a. a traffic relay at each intermediate junction location between sections throughout said stretch coupled into said traffic line circuit network, b. an auxiliary traffic relay associated with each traffic relay and also controlled by said traffic line circuit network and responsive to energy supplied during each reversal of the established traffic, and in which, c. each traffic relay is shunted by a deenergized position contact of the associated auxiliary traffic relay for inhibiting incorrect operation of a traffic relay by induced traffic line circuit voltage surges.

5. A railroad traffic control system as defined in claim 4 in which, each traffic reversal control relay has slow release characteristics for maintaining said traffic line circuit network energized at the selected polarity for a preselected time period after deenergization of the associated super-clear relay during a traffic reversal to assure all traffic relays are positioned to establish the requested traffic direction.

6. A railroad traffic control system as defined in claim 5 in which, said traffic relays control said track circuit means for selectively reversing the direction of each track circuit to detect train occupancy at the entrance end of each track section in accordance with the established traffic route direction.

7. A railroad traffic control system as defined in claim 6 in which, a. each track circuit means comprises,
1. energy transmitting apparatus coupled for transmitting train detection and cab signal energy into the corresponding section rails at the exit end,
2. receiving apparatus coupled for receiving train detection energy at the entrance end of the corresponding section and responsive thereto for registering an unoccupied section, said receiving apparatus registering an occupied section in the absence of energy, b. only a single set of track circuit transmitting and receiving apparatus is required at each intermediate juntion location between adjoining sections selectively coupled to the rails of the adjoining sections in accordance with the established traffic direction for detecting trains moving through the advance section and for supplying train detection energy to the approach section and cab signal energy to approaching trains therein.

8. A railroad traffic control system as defined in claim 5 which further includes, a. a lock relay at each end of said stretch normally occupying a first position and operable to a second position when a train is authorized to or has initially entered said stretch at the corresponding end, b. each lock relay coupled to said block indication line circuit network for inhibiting the energization of the super-clear relay at the established entrance end when the lock relay at the exit end occupies its second position, c. each lock relay also coupled for inhibiting the energization of the corresponding traffic reversal control relay when that lock relay is occupying its second position.

9. A railroad traffic control system as defined in claim 8 in which, a. each track circuit means comprises coded phase sensitive track circuit apparatus controlled by said traffic relays at each end of the corresponding track section for supplying rail energy at the established exit end of that section and for receiving that energy to detect section occupancy conditions at the entrance end, and which further includes, b. a decoding relay at each end and each intermediate location controlled by the associated track circuit receiver apparatus for operating to a first or a second position to register the nonoccupied or occupied condition, respectively, of the advance track section in the established traffic direction, c. each decoding relay coupled to said block indication line circuit for completing that circuit to energize the super-clear relay at the stretch entrance end only when the decoding relay is in its first position.

10. A railroad traffic control system as defined in claim 9 in which, the track circuit apparatus at each intermediate junction location between adjoining sections includes only, a. one phase sensitive unit coupled by the associated traffic relay to the advance section in the established traffic direction for detecting occupancy of that section, b. one source of track circuit energy coupled by the associated traffic relay to the approach section in the established traffic direction for supplying train detection and cab signal energy thereto, and c. one decoding relay controlled by the associated phase sensitive unit for operating to its first or second position as said advance is nonoccupied or occupied, respectively.

11. A railroad traffic control system as defined in claim 4 in which, the application of a temporary source of energy of predetermined polarity at one end of said traffic line circuit network but excluding the portion controlled by the corresponding traffic reversal control relay and route request means positions said traffic relays to a corresponding position for establishing a selected traffic direction after a lock out condition has occurred.

12. A railroad traffic control system as defined in claim 1 which further includes, a. a second super-clear relay at each end of said stretch coupled into said block indication line circuit network in parallel with the first super-clear relay, the first and the second super-clear relays at the same end operably responsive to different polarities of the energy applied to said block line circuit network at the other end,
1. each second relay further controlled to be energized at either polarity only when no entering route request is registered and no train movement entering said stretch at corresponding end is authorized or initiated, b. a block clear relay connected in series with said block indication line circuit network at each end for responding only to energization of the circuit network from the corresponding end, c. a traffic reversal control relay at each end of said stretch controlled by the associated second super-clear relay to be energized and deenergized as the associated super-clear relay responds to energy supplied to said block line circuit network or releases, respectively,
1. each traffic reversal control relay having slow acting characteristics in responding both to energization and deenergization, d. a traffic route request means at each end of said stretch selectively operable for requesting the establishment of a traffic route entering said stretch at the corresponding end and coupled to said block line circuit network for pole changing the energy supplied from that end exclusive of the associated block clear relay, and in which e. said traffic line circuit network is controlled by said traffic reversal control relays and said traffic route request means for establishing the requested traffic route in the desired direction when the traffic route request means at the selected entrance end is operated to its request condition and the traffic reversal control relay at the exit end is in its energized position,
1. said exit end traffic reversal relay delaying the application of energy to said traffic line circuit network for the predetermined pick up delay period to assure the second super-clear relay at the selected entrance end remains picked up and delaying the deenergization of said traffic line circuit network for the predetermined slow release period to assure all traffic relays are positioned to establish the requested traffic direction.

13. A railroad traffic control system as defined in claim 12 which further includes:

a. a traffic relay at each intermediate juntion location between sections throughout said stretch coupled into said traffic line circuit network, b. an auxiliary traffic relay associated with each traffic relay and also controlled by said traffic line circuit network and responsive to energy supplied during each reversal of the established traffic, and in which, c. each traffic relay is shunted by a deenergized position contact of the associated auxiliary traffic relay for inhibiting incorrect operation of a traffic relay by induced traffic line circuit voltage surges.

14. A railroad traffic control system as defined in claim 13 in which, a. each traffic relay is of the magnetic stick type operable to a first or a second position as the first or second direction is to be established, b. the energy supplied to said traffic line circuit network is selectively polarized by the traffic reversal control relay at the requested exit end for positioning said traffic relays in the position corresponding to the requested traffic direction.

15. A railroad traffic control system as defined in claim 14 in which, said traffic relays control said track circuit means for selectively reversing the direction of each track circuit to detect train occupancy at the entrance end of each track section in accordance with the established traffic route direction.

16. In a railroad traffic control system for a stretch of track divided into insulated sections and over which trains move in either direction, the combination comprising, a. a reversible traffic line circuit network extending through said stretch and including at each end location a traffic direction relay operable to a first position for establishing traffic entering the stretch at the corresponding end and to a second position when traffic is to exit at said corresponding end, b. a super-clear relay at each end location, c. a block line circuit network extending through said stretch and including at each end location,

1. a first circuit path including second position contacts of the corresponding traffic relay and a contact closed for supplying operating energy when a train neither is authorized to enter nor has entered said stretch at the corresponding end, and

2. a second circuit path including first position contacts of said corresponding traffic relay, the winding of said super-clear relay at that location, and a contact closed when the advance track section is unoccupied, d. said block line circuit network further controlled by other contacts responsive to the occupancy condition of the track sections within said stretch for supplying energy from the established exit end to the super-clear relay at the established entrance end only when said stretch is unoccupied by any train, e. said traffic line circuit further controlled at each end location by,

1. contacts responsive to a reversed route entrance request for completing a traffic line circuit loop at that end to establish a route entry location. and

2. contacts responsive to the operation of the corresponding super-clear relay for supplying operating energy to said traffic line circuit, when the corresponding location is the exit end of the requested reversed route, poled to position the traffic relays to establish the reverse traffic direction requested when the super-clear relay indicates the stretch is unoccupied.

17. A railroad traffic control system as defined in claim 16 which further includes, a. a track circuit means for each track section coupled for detecting a train occupying the associated section and for supplying cab signal energy into the section rails to control cab signal apparatus on trains traversing the section, and b. an entry signal at each end location controlled by the corresponding super-clear relay for displaying a signal indication authorizing a train without operative cab signal apparatus to traverse said stretch when said corresponding super-clear relay is energized.

18. A railroad traffic control system as defined in claim 17 which further includes, a. a traffic relay at each intermediate junction location between adjoining track sections controlled by said traffic line circuit network to a first or a second position in accordance with the established traffic direction, and in which, b. each track circuit means is controlled by the traffic relays at each end of the corresponding section for supplying the cab signal energy at the exit end and detecting trains at the established entrance end of that section in accordance with the established traffic direction.

19. A railroad traffic control system as defined in claim 18 which further includes, a. a traffic route request means at each end location selectively operable for requesting a traffic route entering said stretch at the corresponding end, b. a lock realy at each end location normally occupying a first condition and operating to a second condition when a train is authorized to enter or has initially entered said stretch at the corresponding end, c. a traffic reversal control relay at each end location controlled by the associated lock and super-clear relays for repeating the energized stretch clear condition of said associated super-clear relay only when the associated lock relay is in its first condition, and in which, d. said traffic line circuit network is also controlled by said traffic reversal control relays for supplying energy poled to position all said traffic relays to establish the requested traffic route direction, and e. each traffic reversal control relay has slow release characteristics for assuring the repositioning of all traffic relays during the establishment of a new traffic route direction.

* * * * *